United States Patent [19]

Meyer

[11] Patent Number: 4,878,764

[45] Date of Patent: Nov. 7, 1989

[54] DRAW-STRING CARRYING BAG

[76] Inventor: Alfons Meyer, Wallensteig 6, D-7056 Weinstadt 3, Fed. Rep. of Germany

[21] Appl. No.: 191,605

[22] Filed: May 9, 1988

[30] Foreign Application Priority Data

May 28, 1987 [DE] Fed. Rep. of Germany ..... 8707670

[51] Int. Cl.[4] ..... B65D 33/28

[52] U.S. Cl. ..... 383/72; 383/75; 383/7

[58] Field of Search ..... 383/72, 75, 76, 92, 383/7, 13

[56] References Cited

U.S. PATENT DOCUMENTS 3,010,640 11/1961 Kugler ..... 383/75

3,653,583 4/1972 Meyer ..... 383/75

*Primary Examiner*—Willis Little

*Attorney, Agent, or Firm*—Frishauf, Holtz, Goodman & Woodward

[57] ABSTRACT

To increase the carrying capacity of foil bags, for example plastic foil bags, in which the mouth (2) of the bag is surrounded by seams (3, 4) forming ducts through which pull cores (9, 10; 11) are passed, openings (14) formed in the seams are so shaped that the edges of the openings adjacent a fold line (13) of the seams have mutually approaching or converging or projecting regions (17) which, when the pull string or cords are pulled out of the openings, cause the approaching regions to fold back and form reinforcing collars, thus preventing tearing of the seams by preventing occurrence of a notch effect, and, by accumulating material upon corrugating or pleating of the material when a load is being placed in the bag, to provide an accumulation of material at the highest stress point.

19 Claims, 4 Drawing Sheets

DRAW-STRING CARRYING BAG

The present invention relates to a draw-string carrying bag, and especially to such bags made of thin material such as plastic foil, in which a carrying cord is retained within a sleeve-like seam at the mouth edge of the bag so that the bag can be carried on the cord and the mouth of the bag pushed together for, effectively, closing the bag.

BACKGROUND

Various types of foil bags are in daily use. Bags may, either, have carrying handles formed or punched therein, and other types have a draw string at the mouth end of the bag. The draw string may be a single draw string or of the double draw-string or cord pull type. In the double-string type, two draw strings can be pulled against each other to close off the mouth of the bag.

Some bags have cut, generally U-formed handles thereon. Making bags of this type is wasteful during production since a substantial quantity of cut-off material becomes waste, which has to be removed, and causes difficulty in recycling. The handles which are formed are subject to high loading and, consequently, the carrying capability of the bags is limited.

Bags with draw strings or cords can be carried by using the cords which come out of the channels formed by the end seam. It has been found that using the cords as carrying elements, the plastic foil at the edge where the cord leaves the seam tends to tear. The concentrated forcec applied at the exit point of the cord leads to increased stresses which, in part due to the notch factor, then causes tearing of the foil. Starting from such tears, the seam at the mouth end of the bag can be cut open by the cord, causing the bag to open and release from the cord, that is, dropping off. Any fragile articles within the bag may then be damaged or destroyed.

THE INVENTION

It is an object to provide a draw-string type of foil bag which can be made easily and inexpensively, and which is so arranged that undesired cutting into the material of the bag by the cord or draw string is effectively prevented even if the bag is heavily loaded.

Briefly, the channel is arranged to have prescored or perforated regions which can be torn open upon use to form an opening. This opening will be located adjacent the free edge of the channel at the mouth of the bag to permit access to at least one cord or draw string located within the channel. In accordance with an important feature of the invention, the opening is so formed that the adjacent edges surrounding the opening extend or project towards each other to form mutually approaching regions which, upon pull-out of the cord from the opening and through the channel, causes the region to form collar-like folds or pleats adjacent the folded over edge of the bag defining the channel.

The arrangement has the advantage that the collar-like folds which will form adjacent the opening result in accumulation of foil material and prevent the occurrence of notch effects at the points at which the greatest stress is placed on the bag. This substantially increases the ability of the bag to resist tearing and especially tearing at the exit point of the cord from the channel in which it is placed.

The arrangement has the additional advantage that the cords or draw strings can be used as carrying elements even if the bag is filled with heavy articles, or tightly packed, without danger of tearing of the plastic foil at the exit openings of the cords or draw strings, and thus preventing drop-off of the bag.

Forming the region surrounding the exit openings of the cord in accordance with the invention does not result in additional waste or cut off foil material and thus does not contribute to increased material use; likewise, the cut, score line or perforation can be made by existing machinery and does not increase manufacturing costs. Simple punching, scoring or perforating tools can be used to make the specific exit opening in accordance with the present invention.

In a preferred embodiment, the exit opening is formed in both walls which define the duct or channel through which the cords are placed. The openings in both walls may be the same; for some applications, however, it may be desirable to form the exit opening in the respective forward and rear wall of the channel to have different shape or different size. For ease of gripping of the cord or draw string, it is sometimes desirable to so shape the opening that the wall defining the channel which is at the inside of the bag at the mouth region, is smaller than the opening at the outer wall side.

The exit opening can be partly preformed, being punched out or cut out during manufacture of the bag. For esthetic reasons, and also for reasons of easy handling of the bags before they are being used, it may be of advantage, however, to leave the exit opening closed until the bag is first used. In that case, the edge of the channel will not be severed or cut in the region of the opening. The material of the channel, where the opening is to occur, is formed with a perforated, scored or otherwise formed shearing or breaking line. Such a breaking line, preferably, is located at the center of the opening to be formed, to be torn open by the user or, for example, by a sales person first handing the filled bag to a customer, thereby exposing the draw string for the customer's use. Perforations, starting tear notches, or weakened tear lines may be used.

DRAWINGS ILLUSTRATING EXEMPLARY EMBODIMENTS

DETAILED DESCRIPTION

Figure 1:
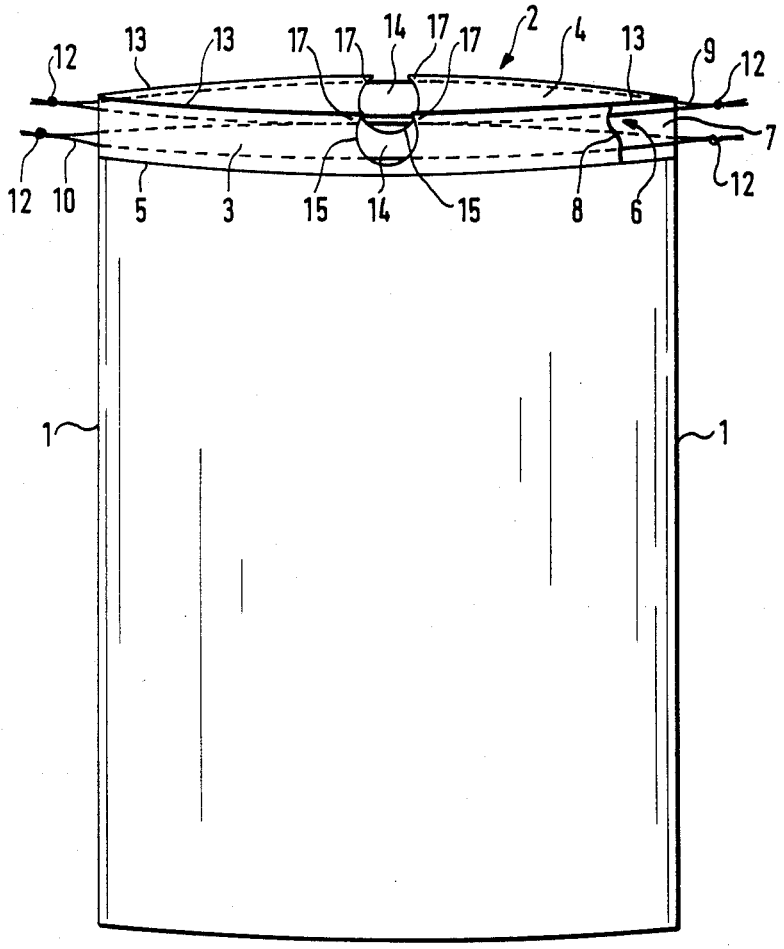
FIG. 1 is a schematic part-perspective representation of a draw-string carrying bag having two draw strings.

The bag having the features of the present invention may be of any desired shape. FIG. 1 illustrates a thin thermoplastic bag formed, for example, of a half-tubular element and welded together at the edges 1. The general shape is rectangular, to form an essentially rectangular pocket-like element. The mouth opening of the bag 2 is formed with two oppositely located, folded-over end portions to define channels 3, 4. The channels are formed by an end portion 7 of the adjacent respective side or panel of the bag and a folded-over flap portion 8. Flap 8 is seamed, e.g. welded, to the side panel as schematically shown at 5, for example by well-known heat-sealing or heat-seaming. Each one of the channels 3, 4 defines a duct or hollow 6 between the side wall portions 7, 8.

Figure 8:
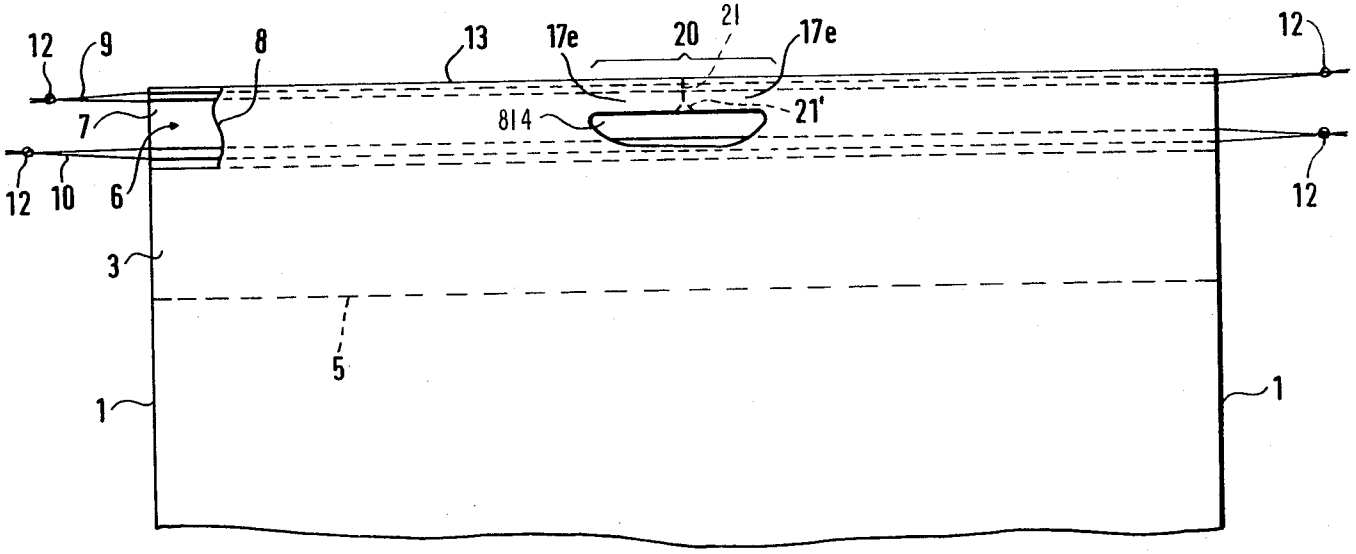
FIG. 8 is a fragmentary side view of the bag illustrating a tear-open opening.

The draw string to close the bag may be in accordance with the well-known double-pull arrangement shown, for example, in FIGS. 1 and 8. The two ducts 6, each, have respective cords 9, 10 located therein, knotted for example at the ends 12. The two cords 9, 10 surround the mouth 2 of the bag. They can emerge at the edges of the ducts 6 at the sides; as will appear, they can be pulled out centrally of the bag to form carrying handles.

Figure 2:
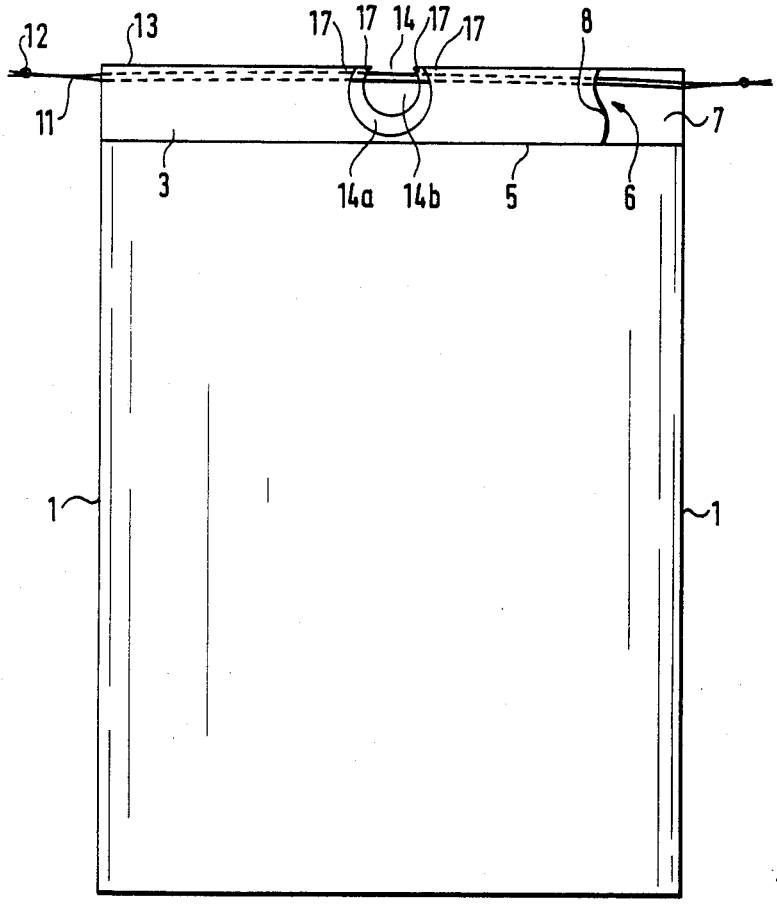
FIG. 2 is a part-perspective schematic representation of a carrying bag having a single draw string.
Figure 3:
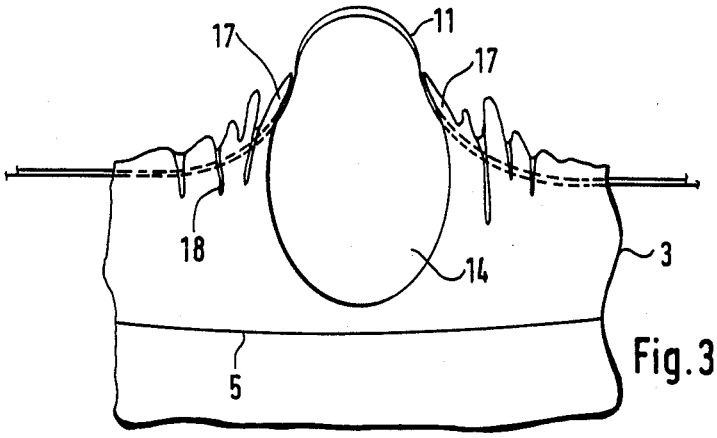
FIG. 3 is a detailed enlarged view illustrating the region of the opening adjacent the draw string when a draw string is pulled through the opening.

The embodiments of FIGS. 2 and 3 illustrate a bag in which only a single cord 11 is placed in the channel seams 3, 4 forming the ducts 6. The single cord 11 can be formed of two cord elements, knotted together at 12—see FIG. 2.

Exit openings 14 are formed essentially centrally in the side walls or panels of the bag, penetrating the channel-forming seams 3, 4. These openings pass through the folding edges 13 of the respective seams 3, 4. The openings 14 permit access to the cords or draw strings 9, 10, 11, respectively. The openings 14 are located on both lateral sides of the mouth 2 of the bag, in mutual alignment, so that they are associated with each other in pairs.

More than one such exit opening 14 can be located along the seams 3, 4 adjacent the mouth 2 of the bag, associated with each other in pairs, to permit for example carrying the contents of the bag either by the user's hand entirely gripping the cords or draw strings, or the fingers, individually, looping beneath the cords or draw strings.

To use the bags, the user grips the portions of the cords exposed at the openings 14 with the fingers, and pulls the cords from the associated ducts formed by the seams 3, 4, to thereby flex the cords to form essentially U-shaped carrying handles. The cords 9, 10 or 11, respectively, cross the exit openings 14 of the flat bag as best seen in FIGS. 1 and 2, and thus can be easily gripped.

In accordance with a feature of the invention, the exit openings 14 are so shaped that their edges 15 have mutually approaching or converging regions 17, located close to the folding-over edge 13 of the respective channel-forming seam 3, 4 (FIGS. 1 to 7) or extend longitudinally along the edge 13 of the associated seams 3, 4. These mutually approaching regions 17 constrict the effective width of the opening 14 at the edge 13 where the seams 3, 4 are folded over. Thus, at the opening itself, the maximum clearance or opening width is wider than the clearance or opening width at the edge 13. In the embodiment of FIG. 8, where the opening is to be formed later by tearing along a score line 21, for example, the opening referred to above and in connection with FIG. 1 is formed later. Thus, when reference is made to an "opening" 14 herein, the description is intended to equally apply to an opening to be formed, as will be described in connection with FIG. 8, below.

Upon gripping of the respective cords or draw strings accessible through the opening 14 by the fingers of the user, and pulling out the cord or draw string, the region of the foil bag adjacent the opening will deform as seen in FIG. 3. The converging approaching region 17 will be folded in corrugated collar form along the transverse dimension of the bag in order to permit the bag part to fit against the externally projecting parts of the cord or draw string. Portions of the material of the seams 3, 4 adjacent the opening 14 may even fold themselves back, towards the outside or towards the inside of the duct 6. The result, upon carrying heavy articles within the bag, will be to reinforce the region at pull-out of the cords or draw strings so that loading placed by the fill within the bag will not cause a notch effect to arise at the folded-over edges 13 which form the folded-over seams 3, 4. This accumulated pushed-together material at the draw-out point of the cords or draw strings thus reinforces the foil and substantially increases the resistance of the foil to tearing at the point of exit for carrying the bag.

The edges of the openings 14 can have different shapes, depending on required use, size and carrying capacity of the bag, material of the bag and the like.

FIG. 1 illustrates an embodiment in which the exit opening 14 is part-circular, and formed on both sides of the mouth 2 of the bag in identical manner. The fold-over edge 13, when extended theoretically across the opening 14, would form a chord to the circle which is defined by the circular opening 14; the part-circle which is left is identified at 15 in FIG. 1. The center of the circle 15 is spaced downwardly from the fold edge 13 so that converging, mutually projecting tips 17 will be formed along the folding edge 14.

FIG. 2 illustrates a bag in which a single draw string 11 is used. The opening 14 is part-circular, and is defined by two cut-outs **14*a*, 14*b* formed, respectively, in the walls 7 and 8 defining the duct 6 receiving the draw string 11. The inner wall 7 has the smaller opening 14*b* formed therein; the opening 14*a* in the outer wall is larger, as clearly seen in FIG. 2**.

To form the openings, it is usually desirable to punch out or cut out the openings 14 before folding over of the seams 3, 4 and before introducing the cord 11, or (FIG. 1) before introducing the cords 9, 10 into the flat foil material. The profiles of the respective punch elements for different types of openings are shown in FIGS. 4 to 7. When folding over the seams 3, 4 to form the folded edge 13, the respective openings 14 will result.

Figure 4:
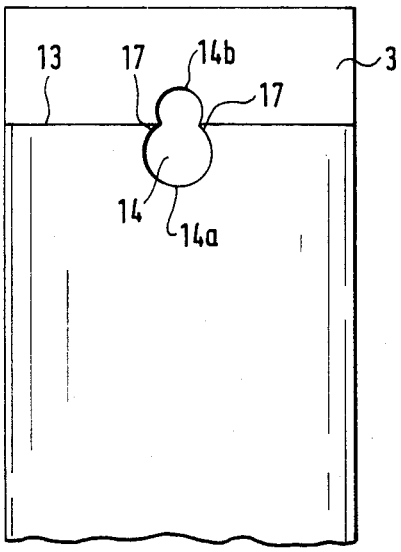
FIG. 4 is a plan view of the opening of FIG. 2 before the channel seam is made, and with the draw string removed.

FIG. 4: The flat punch-out form will generate the bag shown in FIG. 2. The two part-circular openings **14*a*, 14*b*, when folded together about the folding edge 13, will form the elements 3, 4, and then define the common opening 14. The edges 14*a*, 14*b* intersect each other at the folding-over edge 13. The approaching, mutually projecting regions 17 are formed by the cut-out portions adjacent the folding edge 13, to define sharply pointed projections which, upon pulling out of the draw string, form the corrugated, bellows-like collar portion shown in FIG. 3**.

Figure 5:
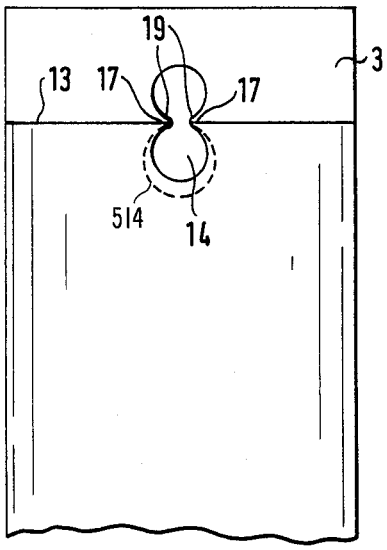
FIGS. 5, 6 and 7 are illustrations similar to FIG. 4 and showing other embodiments of the invention.

FIG. 5 illustrates an arrangement which, when folded along the line 13, will form the bag of FIG. 1. The two part-circular openings will be congruent so that, when folded together, the opening 14 will be defined. The projecting approaching tips 17 need not be pointed or sharp; rather, some slightly convexly shaped curved regions 19 can be formed so that the overall punch profile will essentially have "8" shape.

Figure 6:
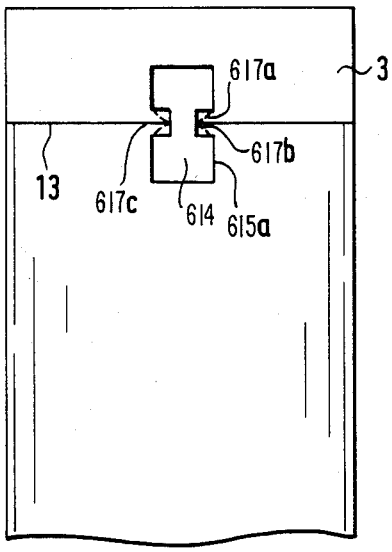

FIG. 6 illustrates an alternative arrangement in which the exit opening 614 has an essentially rectangular edge **615*a*. The sides of the rectangle are parallel to each other, and the bottom is parallel to the folding-over edge 13. The mutually approaching end portions 617*a*** have right-angle corners; these corners, of course, at the exact corner points can be rounded.

The rounding of the corners 617*a* is shown at 617*b*, for better visualization, in dotted lines. The mutually projecting regions 617*a* need not be the same at both the right and left sides—with respect to FIG. 6—but may be different. Thus, the corners at the right side can be rounded as shown at 617*b* and at the left side the corners of the essentially rectangular cut-out can be straight as seen at 617*c*, to form a somewhat pointed, arrowhead-shaped projecting region. This arrowhead-shaped projecting region, again, is shown in broken lines for better visualization.

Figure 7:
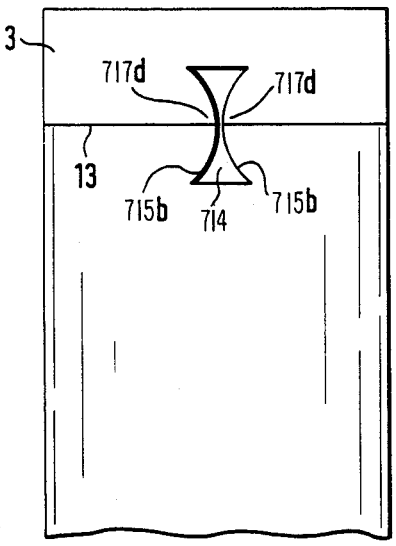

FIG. 7 illustrates another alternative in which the opening 714 is limited on both sides by essentially convex regions 715*b*, directed towards each other. The converging regions 717*b* define end portions 717*d*. The two limiting lines 715*b* can touch each other in the region of the folding edge line 13; the cut-out 714, thus, can be formed in two portions with a small connection at the center, to be torn apart when the cord or draw string is pulled therethrough in use of the bag. Other arrangements may be used, for example in which the respective cut-out limits 715*b* are so placed that they intersect each other, thus leaving, inherently, a larger opening.

When the bag is formed, so that the portion 3 is folded over at the folding edge line 13, the opening 4 will be generally funnel-shaped. Funnel-shaped arrangements can also be formed in the openings shown in FIGS. 4, 5 or 6, for example by forming score lines 514, which can also be placed next to an existing opening, for subsequent formation of a somewhat larger opening, as shown in broken lines in FIG. 5.

In the embodiments heretofore described, the opening 14 or 614, 714 is punched out or cut out before the bag is finally formed. In some bags, and particularly in bags where the outer appearance is of importance, a punch or cut-out open at the edge may be undesirable. The arrangement, thus, can also be made, as shown in FIG. 8, such that the exit opening 14 is left closed during initial manufacture, and defined only by a tear or perforation line, following, generally, the edges 15, 615*a*, 715*b*, so that the exit opening 14, 614, 714, respectively, is closed until the bag is first used. When the bag is first used, the exit opening 14 is formed by pressing out the foil element, forming the exit opening, manually along the perforation line.

FIG. 8 illustrates an embodiment of the invention in which the exit opening 814 for the draw strings or cords is punched out but, with respect to the folding edge 13, is closed by a narrow strip 20. The narrow strip 20 has a break or tear line 21 formed therein, extending at right angles to the folding edge 13. The break or tear line 21 which, of course, can equally be formed by a tear notch 21', a perforation, or other weakened region, is placed centrally of the opening 814. The opening 814 is elongated and extends generally in parallel to the fold line 13. A suitable shape is shown in FIG. 8, i.e. approximately elliptical or trapezoidal with rounded corners.

When the bag shown in fragmentary form in FIG. 8 is first used, the region 20 is severed into two subregions by tearing along the break or perforation line 21, by itself, when gripping one or both of the cords within the channel 6 formed by the seams 3, 4. This then will again form two projecting mutually approaching regions 17*e*. These regions 17*e*, upon pulling out of the draw strings 9, 10 will be pushed together to form an essentially corrugated-like collar, as described in connection with FIG. 3. The mutually facing regions 17*e*, before being pushed together, extend along the fold line 13, so that the region 20 is defined by essentially parallel flanks.

Of course, the region 20 and the break line 21 can be formed differently. For example, the width of the region 20 could be so made that, in the region of the break line 21, it is a minimum. The single perforating line 21 can also be replaced by two perforating lines with a tiny flap in the middle which is discarded, to form two essentially pointed converging portions 17*e* when the break line 21 is torn.

In accordance with a preferred form of the invention, each one of the side walls of the bag is formed with an opening 14, 614, 714, 814, the openings in parallel side walls being aligned. This is not a necessary feature, however, since bags can be formed which have only a single opening, located either in the seam 3 or in the seam 4 and, upon drawing together, closing off the mouth 2 of the bag. The openings can also be so made that they penetrate through only one wall 7 or 8 of the seam, although for highest carrying capacity and best tear resistance, the embodiments described in which both the walls 7 and 8 are perforated or will become torn (FIG. 8) are preferred. In accordance with another modification, only one of the walls of the seams 3, 4, respectively, is formed with a cut-out at the time of manufacture, the other wall being formed with a perforating or tear line matching the cut-out. At the time of first preparation of the bag, thus, the side walls will present a uniform smooth uncut appearance. Upon first use, the side wall which was merely perforated formed with a break line then is torn.

From a manufacturing point of view, and in regard to the manufacture of cutting or punching or perforating tools, it is simplest if the exit opening is entirely or partly of circular or oval shape—see FIGS. 1–5.

Forming the cut-out in essentially funnel shape (FIG. 7) may be desirable for some applications, particularly in view of the pleasing appearance. A particularly good arrangement for the converging or approaching regions has been found by so forming the exit opening that it has essentially convex curved shape. The foil elements approaching each other then can all be rounded, and not have pointed regions, thus contributing further to resistance against tearing.

The exact shape of the exit opening can be in accordance with a desired use of the bag, and its desired appearance. The square arrangement shown in FIG. 6—preferably with some rounding, as shown at 617*b*—readily permits an arrangement in which the mutually approaching edge zones are, selectively and as desired, separated at the time of manufacture or formed joined together, with a tear line such as tear line 21 (FIG. 8). Gradually merging regions are preferred, particularly when merging with convexly curved regions, to provide for smooth travel of the draw strings or cords and decrease of the notch effect.

In some simple cases, it is sufficient that the exit opening is formed only on one side of the mouth 2 of the bag, preferably centrally between the edges 1 of the bag itself. Substantially higher load carrying capability, however, is obtained if two exit openings for the cords are provided, in paired alignment.

A single cord (FIG. 2) is sufficient; for most applications, however, it is preferred to use two cords 9, 10 (FIG. 1) located in the respective channels 6. The material for the bags, usually, is thin plastic of the requisite gauge, in the light of desired carrying capacity. The present invention is not limited to plastic bags, however, but may be used also with bags of other materials, such as paper, thin fabric or other textile material, mesh or the like, collectively referred to as web-like material.

Various changes and modifications may be made, and features described in connection with any one of the embodiments may be used with any of the others, within the scope of the inventive concept.

I claim:

1. Corded or draw-string carrying bag of web-like material, particularly plastic foil, having a mouth portion (2), which mouth portion includes folded-over end portions (8) and seams (5) seaming the folded-over end portion (7) to an adjacent underlying portion (8) of the side of the bag, to define channels (3, 4, 6); and at least one cord or draw-string (9, 10; 11) passed through the channels, wherein, in accordance with the invention, the mouth portion is formed with an opening (14) therein which is free or open for a portion only of the channel, and a solid strip of material (20) is provided, extending, at the mouth of the bag (2) from the opening across the channel and toward said opening, and covering said cord or draw-string;

said solid strip of material being formed with a tear or yield line (21) extending transversely through said solid strip of material to permit tearing the solid strip of material to extend the opening, to then permit access to the at least one cord or draw-string (9, 10; 11), and to form mutually approaching channel regions (17*e*), the mutually approaching regions, upon pulling out of the at least one cord or draw string from the opening and upon tearing or severing of the tear or yield line, causing said mutually approaching regions to form collar-like pleats or folds adjacent the folded-over edge defining the channel.

2. The bag of claim 1, wherein the opening is formed in the folded-over end portions (7, 8) forming opposite walls of the channels (3, 4) and penetrate through said walls.

3. The bag of claim 2, wherein the openings penetrating through the walls (7, 8) of the channels have different configuration to form openings of different size or shape.

4. The bag of claim 3, wherein the opening (14*b*) in the wall (7) of the channel (3, 4) innermost with respect to the bag is smaller than the opening formed in the wall (8) of the channel remote from the mouth opening of the bag.

5. The bag of claim 1, wherein the tear or yield line (21) is located approximately midway of the opening and extends at an essentially right angle with respect to a fold line (13) at the edge of the mouth portion (2) of the bag and formed by the channels (3, 4).

6. The bag of claim 1, wherein the tear or yield line (21) is a perforation line (21).

7. The bag of claim 1, further including a tear notch (21′) located adjacent the tear or yield line (21).

8. The bag of claim 1, wherein the opening is at least part-circular shaped;

and wherein said folded-over edge portions (8) of the web define a folding edge (13) at the end of the mouth portion (2) of the bag, said folded-over edge extending tangentially or as a chord with respect to said at least part-circular shape of the opening.

9. The bag of claim 1, wherein said opening, in plan view, is of elongated shape, and said mutually approaching regions define converging portions of said elongated shape of minimum opening width in the region of a terminal edge (13) of said mouth portion (2) of the bag.

10. The bag of claim 1, wherein marginal portions in the region of a folded-over edge of said channels adjacent the mouth portion (2) have essentially convexly curved shape.

11. The bag of claim 1, wherein the regions surrounding the opening, at least in part, have essentially rectangular corners.

12. The bag of claim 11, wherein said mutually approaching regions are two mutually projecting portions of web material positioned adjacent a folding edge (13) at the mouth portion (2) of the bag and forming a fold for said channels (3, 4).

13. The bag of claim 1, wherein said mutually approaching portions are essentially straight.

14. The bag of claim 1, wherein the terminal portions of said mutually approaching regions adjacent a folding edge (13) defining said channels (3, 4) and at the limiting end of said mouth portion (2) of the bag merge smoothly into each other in form of convex bends (19).

15. The bag of claim 1, wherein said means for defining the opening are provided in each one of the seams (3, 4) at respectively opposite sides of the mouth portion (2) of the bag;

and wherein the openings in the respective ones of the seams are in cross-alignment with respect to the mouth of the bag to form aligned opening pairs.

16. The bag of claim 1, wherein two pull cords are located in the channel or duct (6) defined by the seams;

and two means for defining two openings are provided, located, respectively, in each one of the seams (3, 4) for conjoint pull-out of the respective cords from the respective openings.

17. The bag of claim 1, wherein said opening adjacent the solid strip of material, in advance of severing the tear or yield line (21) is an elongated opening extending laterally from said tear or yield line.

18. The bag of claim 17, wherein said elongated opening is, in plan view, approximately elliptical or trapezoidal, with rounded corners.

19. Corded or draw-string carrying bag of web-like material, particularly plastic foil, having a mouth portion (2), which mouth portion includes folded-over end portions (8) and seams (5) seaming the folded-over end portion (7) to an adjacent underlying portion (8) of the side of the bag, to define channels (3, 4, 6); and at least one cord or draw-string (9, 10; 11) passed through the channels, wherein, in accordance with the invention, the folded-over end portion extends uninterruptedly about the mouth portion to define, with the adjacent underlying portion (8) continuous channels (3, 4) covering said cord or draw-string;

a tear or yield line located approximately centrally of said continuous channels to permit tearing the solid material of said channels to define, when severed, an opening (14), to then permit access to the at least one cord or draw-string (9, 10; 11), and to form mutually approaching channel regions (17*e*), the mutually approaching channel regions, upon pulling out of the at least one cord or draw string from the opening and upon tearing or severing the material of the channels at the tear or yield line, causing said mutually approaching regions to form collar-like pleats or folds adjacent the folded-over edge defining the channel.

* * * * *